United States Patent [19]

Harbarger

[11] Patent Number: 4,940,507

[45] Date of Patent: Jul. 10, 1990

[54] LAPPING MEANS AND METHOD

[75] Inventor: Josephine Harbarger, Phoenix, Ariz.

[73] Assignee: Motorola Inc., Schaumburg, Ill.

[21] Appl. No.: 417,405

[22] Filed: Oct. 5, 1989

[51] Int. Cl.[5] ..... B44C 1/22; H01L 21/306; C03C 15/00; C03C 25/06

[52] U.S. Cl. ..... 156/636; 51/317; 156/662; 156/345

[58] Field of Search ..... 156/636, 637, 639, 645, 156/662, 345; 51/209 DL, 237 R, 281, 317

[56] References Cited

U.S. PATENT DOCUMENTS 3,549,439 12/1970 Kaveggia et al. ..... 156/636

4,826,563 5/1989 Hassett et al. ..... 156/636

*Primary Examiner*—William A. Powell

*Attorney, Agent, or Firm*—Robert M. Handy

[57] ABSTRACT

An improved means and method for polishing or lapping thin wafers, especially semiconductor wafers, in a lapping plate is obtained by providing additional slurry holes in the lapping plate between the wafer receiving holes. In a first embodiment useful with wafers having a small initial taper, the additional slurry holes are radially oriented and have a length about equal to the wafer diameter so that, as the lapping plate rotates in the lap machine, the lapping slurry feeds through the holes to providing slurry uniformly to the underside of the wafers being lapped. In a second embodiment useful for wafers with a large initial taper, slurry holes of varying width and/or length are used to vary the amount of slurry reaching different parts of the wafers so that a predetermined variation in lapping occurs across the wafer to correct the taper. Yield is thereby improved.

20 Claims, 3 Drawing Sheets

LAPPING MEANS AND METHOD

FIELD OF THE INVENTION

The present invention concerns improved means and methods for lapping, polishing and/or grinding thin wafer like materials, especially semiconductor and other wafers used for electronic purposes.

BACKGROUND OF THE INVENTION

It is commonplace in the electronic art to construct devices in and/or on thin wafer substrates. Common wafer materials are semiconductors such as for example, silicon, germanium and gallium-arsenide, and dielectrics such as for example, sapphire, alumina, quartz, doped garnets, combinations of dielectrics and semiconductors, and other materials.

Wafers of these materials are often prepared in large boules which are then sliced into raw wafers typically 50–200 mm in diameter and 0.025–0.25 mm thick. Before they can be used, the raw wafers must be ground or lapped to the final desired thickness and polished and etched to remove sawing and other surface damage.

Lapping and polishing is conventionally carried out in large orbital lapping machines well known in the art. The wafers to be lapped and/or polished are typically placed in circular openings in a lap plate whose thickness is about equal the desired final wafer thickness. The wafers and lap plate are placed between rotating platens of the lap machine. A slurry containing an appropriate polishing media, lubricant and (sometimes) a chemical etchant is introduced between the wafers and the lapping pads on the platens. As the platens of the lap machine turn, gear rings engage the outer perimeter of the lap plate so that they rotate about their centers at the same time that they revolve around the central axis of the lap machine. Thus, the wafers move in an orbital fashion with respect to the polishing pads on the platens. This is desirable for achieving wafers whose thickness is as uniform as possible. Such equipment and methods are well known in the art.

One of the difficulties encountered with prior art lapping and polishing methods is imperfect wafer flatness and planarity. Some of the wafers polished or lapped using such prior art methods show small deviations from perfect flatness and thickness uniformity. The wafers may have a slight thickness taper from one edge to another, or a slight crown toward the center, or be slightly dish-shaped. All such variations are undesirable. Such deviations may arise during the lapping or polishing process or may arise from non-uniformities in the sawing and/or grinding operations that precede lapping or polishing. In either case, these non-uniformities are undesirable since they make it much more difficult to achieve uniform characteristics in the electronic devices constructed in or on the wafers.

It has been discovered that the flatness, uniformity and surface perfection of the wafers obtained using such prior art lapping or polishing methods is very dependent on how the lapping or polishing slurry is distributed on the lap pads. It has also been discovered that prior art means and methods result in a non-uniform distribution of slurry. Further, prior art means and methods for distributing the slurry are not well adapted to correcting wafer non-uniformities that may be present in the raw wafers before the lapping or polishing operation.

BRIEF SUMMARY OF THE INVENTION

Accordingly, it is an object of the present invention to provide an improved means and method for lapping or polishing thin wafers, especially semiconductor wafers. It is a further object of the present invention to provide an improved means and method for distributing slurry to the faces of the wafers being lapped or polished. It is a still further object of the present invention to provide an improved means and method wherein the distribution of slurry may be controlled for the purpose of correcting pre-existing wafer non-uniformities.

These and other objects and advantages are obtained by an apparatus comprising a lapping plate of a predetermined thickness and having multiple wafer holes extending therethrough adapted to receive the thin wafers with their major faces approximately parallel to major faces of the lapping plate, and having multiple slurry holes extending therethrough, wherein the slurry holes are located ahead of and spaced apart from the wafer holes in the direction of rotation of the lapping plate. In a typical configuration the lapping plate is circular with circular wafer holes whose centers are located on a common circumference and the slurry holes have long dimensions arranged on radii of the circular lapping plate between the wafer holes. Where the wafer holes are arranged on a common circumference, it is desirable that the slurry holes have inner and outer ends at predetermined radii of the lapping plate which are, respectively, approximately equal to radii of inner and outer circumferences tangential to the wafer holes.

For substantially uniform lapping it is desirable that the slurry holes have a substantially uniform circumferential width. By providing slurry holes of varying width and/or length, the slurry may be delivered non-uniformly to facilitate correcting pre-existing wafer taper or other wafer artifacts.

Where the lapping plate is circular and has N evenly spaced circular wafer holes of equal diameter tangential to spaced-apart first and second circumferences, it is desirable that there be N slurry holes located between the N wafer holes and at least partly between the first and second circumferences.

An improved method for treating thin wafers is obtained by utilizing the above-described lapping plate. The wafers to be lapped are placed in the above-described lapping plate in a conventional lapping apparatus so that the wafers and lapping plate are in contact with the lapping pads or platens. The lapping plate is rotated while slurry is fed to the upper surfaces of the wafers and lapping plate and to the slurry holes. The slurry holes conduct the slurry through the lapping plate to the lower lapping pads or platen where it can reach the lower surfaces of the wafers. The amount and distribution of the slurry on the lower wafer surfaces is determined by the shape and extent of the slurry holes in the lapping plate. This facilitates correction of initial taper or other non-uniformities in wafer thickness and/or planarity.

The above and other objects, features and advantages of the present invention will be better understood from the following description taken in conjunction with the accompanying drawings.

DETAILED DESCRIPTION OF THE DRAWINGS

Figure 1:
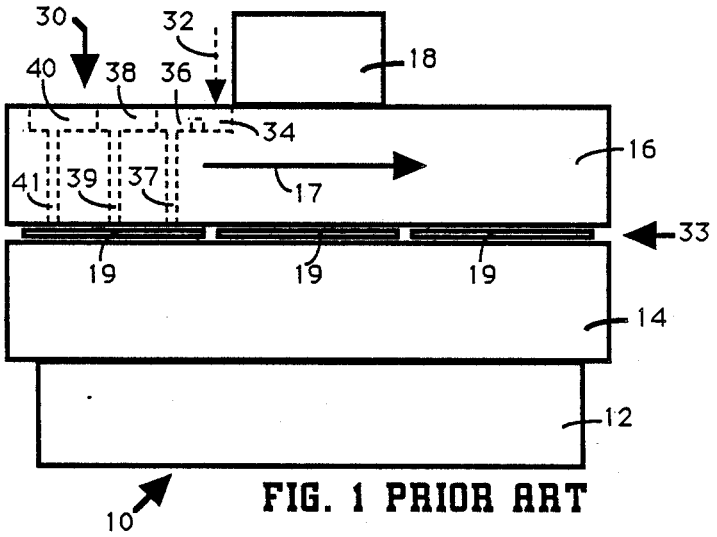
FIG. 1 PRIOR ART
FIG. 1 is a side view and FIG. 2 is a partially cutaway top view, much simplified, of a conventional polishing or lapping apparatus suitable for use with the present invention and showing how lapping plates and wafers are located and moved therein.
Figure 2:
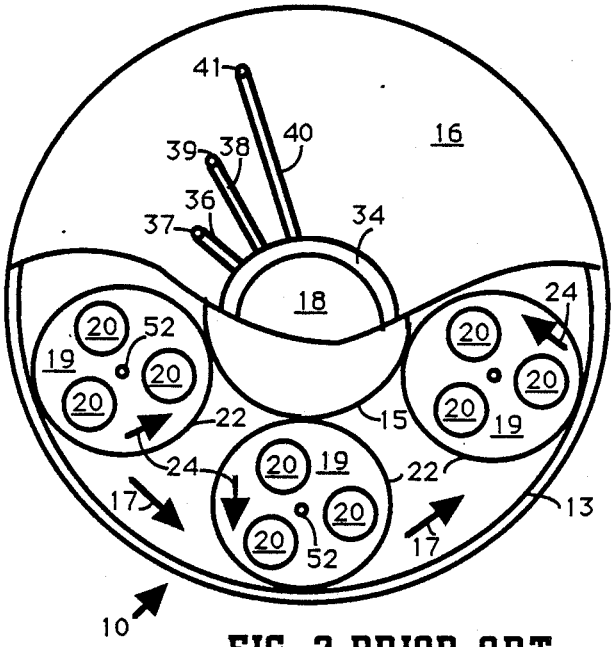
FIG. 2 PRIOR ART

FIG. 1 is a side view and FIG. 2 is a partially cutaway top view, much simplified, of conventional polishing or lapping apparatus 10 suitable for use with the present invention and showing how lapping plates 19 and wafers 20 are located in space 33 and moved therein. Apparatus 10 comprises base 12, lower platen 14, upper platen 16 and drive 18, which moves upper platen 16, for example, in the direction shown by arrow 17. Lapping plates 19 containing wafers 20 are located between platens 14, 16. Outer circumferences 22 of lapping plates 19 typically have gear teeth (not shown) which engage outer gear 13 and/or inner gear 15 on lapping apparatus 10 so that as platens 14 or 16 rotate with respect to each other in direction 17, lapping plates 19 further rotate as shown by arrows 24. Thus, wafers 20 describe an orbital motion on platens 14, 16. It is customary to use lapping pads (not shown) on plates 14, 16. Such apparatus is well known in the art, and a typical commercial lapping machine suitable for lapping or polishing semiconductor wafers is the Model AC-1000 manufactured by the Peter Walters Company of West Germany.

Lapping apparatus 10 generally includes slurry dispensing system 30. Slurry 32 is introduced into circular channel 34 from whence it flows via radial channels 36, 38, 40 to holes 37, 39, 41 extending through upper platen 16 into inter-platen space 33 wherein are located lapping plates 19 and wafers 20. Slurry dispensing system 30 is shown schematically in side view in FIG. 1 and top view in FIG. 2. Slurry dispensing system 30 is conventional. Slurry dispensing system 30 dispenses slurry 32 to the upper side of lapping plate 19 and wafers 20 located in interplaten space 33.

Figure 3:
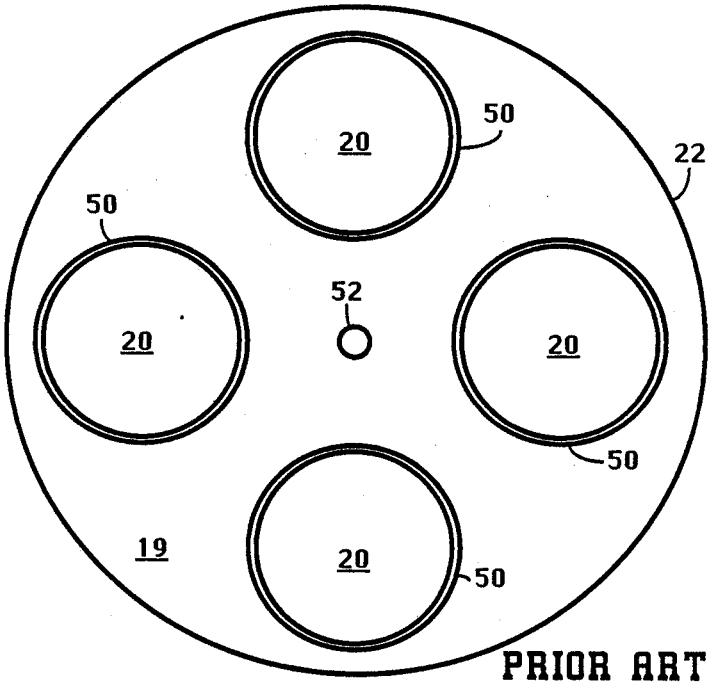
PRIOR ART FIG. 3
FIG. 3 is a top view of a prior art lapping plate.

FIG. 3 shows a top view of prior art lapping plate 19. Lapping plate 19 has holes 50 for receiving wafers 20 and central hole 52 for allowing slurry 32 to flow from the upper side of lapping plate 19 and wafers 20 to the under or lower side of lapping plate 19 and wafers 20, when lapping plate 19 and wafers 20 are in lapping apparatus 10. Some slurry also can flow between the edges of wafers 20 and holes 50, but since the clearance between wafer 20 and holes 50 is generally small, the amount of slurry supplied in that manner is usually, by itself, insufficient and the pathway provided by central hole 52 is also needed.

While the lapping plate arrangement of FIG. 3 is useful, it has been found that central slurry hole 52 does not provide an ideal distribution of slurry to the lower surface of the wafers and that lapping and polishing of the wafers is thereby less than ideal. Further, there is no way with prior art lapping plate 19 to vary the slurry delivery to the under side of the wafers so as to take into account or compensate for initial wafer taper.

Figure 4:
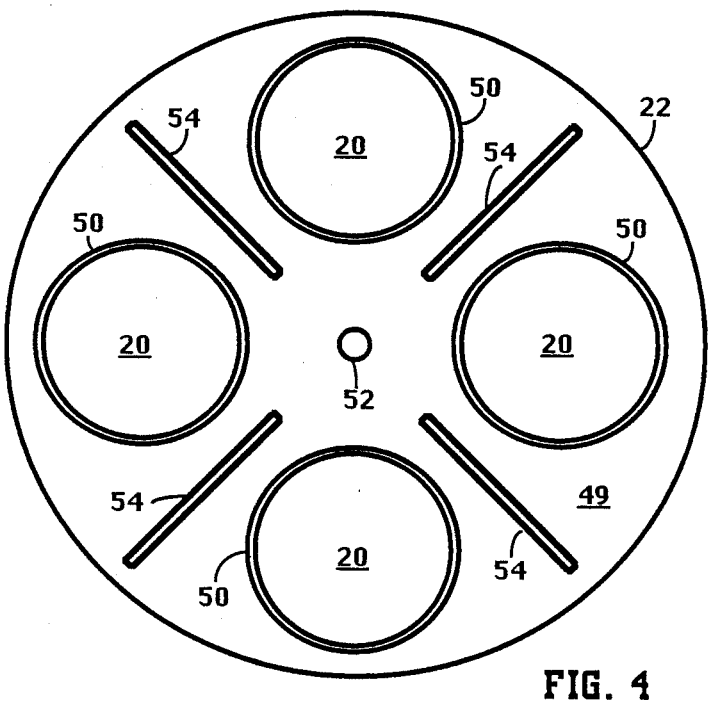
FIG. 4 is a top view of a lapping plate according to a first embodiment of the present invention.

These problems are overcome by the present means and method illustrated, in a first embodiment, in FIG. 4. FIG. 4 shows lapping plate 49 according to a first embodiment of the present invention. Lapping plate 49 is installed in apparatus 10 in the same manner as lapping plate 19.

Lapping plate 49 has therein holes 50 for receiving wafers 20, as before. It may also have central slurry hole 52, but that is not essential. Additional slurry holes 54 are provided between wafer holes 50 to facilitate uniform distribution of slurry 32 from the upper to lower surfaces of lapping plate 49 and wafers 20. It is preferred that slurry holes 54 be located between wafer holes 50 and, approximately between the inner and outer circumferences that are tangential to holes 50 in circular plate 49. Holes 54 act as reservoirs and/or conduits for slurry and dispense the slurry substantially uniformly across the lower faces of wafers 20 as plates 49 as they rotate.

While holes 54 may have varying length, it is convenient that their length be approximately equal to the diameter of holes 50 and that they extend approximately from the inner to the outer circumferences tangential to holes 50. However, as those of skill in the art will appreciate based on the description herein, holes 54 may have varying location and length according to the location and size of holes 50 and the amount and location of slurry delivery that is desired.

For example, during rotation of lapping plate 49, an individual slurry hole 54 leads an adjacent individual wafer hole 50 containing an individual wafer 20 and primarily supplies slurry to the underside thereof. Thus, the location of an individual slurry hole 54 with respect to its adjacent trailing wafer hole 50 and corresponding wafer 20 that trail hole 54 in rotation, may be adjusted in radial position and extent to feed the desired amount of slurry to the trailing wafer. While for simplicity of explanation, wafer holes 50 have been shown as all being on the same circumference and holes 54 also, this is not essential. Those of skill in the art will understand based on the description herein how to vary the location and extent of holes 54 to feed the desired amount of slurry to the wafers without undue experimentation.

Figure 5:
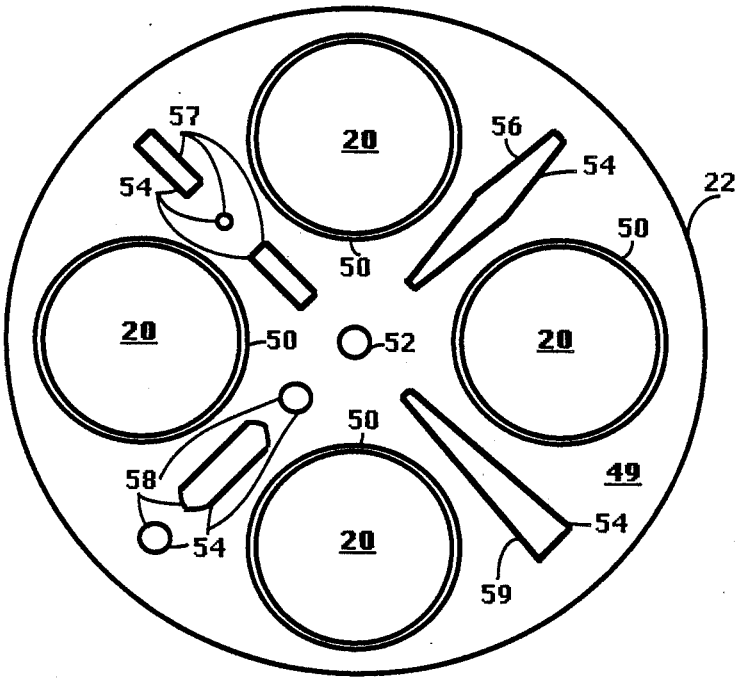
FIG. 5 is a top view of a lapping plate according to further embodiments of the present invention.

FIG. 5 is similar to FIG. 4 except that various modifications in the shape and location of holes 54 are shown, illustrating how the slurry supply can be varied by varying the location and shape of holes 54 to achieve different lapping and polishing results. For example, if the wafer tapers in a direction oriented radially with respect to the lapping plate, the circumferential width of slot 54 may be varied as a function of radius on plate 49 so that a larger (or smaller) supply of slurry is provided at different radii. This is illustrated in slots 56–58 in FIG. 4. If the wafer is crowned, then slot 54 may be restricted in extent or have a central bulge so as to provide more slurry to the center of the wafer or, if there is a peripheral bulge, so as to provide more to the periphery of the wafer. These are illustrated at 59, 60 in FIG. 4. Those of skill in the art will understand, based on these examples, how to provide other variations and combinations to deal with various types of non-uniformities in the starting wafers and to compensate for various nonuniformities that may otherwise occur during lapping or polishing.

In practicing the invention, one places the above-described lapping plate with wafers between the pads and platens of lapping apparatus 10 and feeds slurry 32 thereto while platens 14 and/or 16 are rotated. Slurry holes 54 allow the desired amount of slurry to reach the underside of lapping plate 49 and wafers 20 so that the desired lapping and/or polishing is accomplished.

As those of skill in the art will appreciate, while the present invention has been described using the words "lapping" or "polishing", the amount of material removed, the rapidity of removal and the smoothness and flatness of the finished surfaces may be varied, among other things, by changing the slurry material. A variety of slurries for different purposes are well known in the art and may be used in conjunction with the present invention. The words "lapping" and "polishing" are intended to include all such variations.

EXAMPLE

The following Table compares the flatness and runtime results of lapping silicon wafers of 125 nm diameter and about 0.66 mm initial thickness with a standard slurry composed of 15 micrometer diameter aluminum oxide grit in a solution of water and a commercial suspension agent (type GL-6 supplied by Professional Chemical Company of Chandler, AZ). The test runs were made in a Peter Walters Model AC-1000 commercial lapper using the lapping plates shown in FIGS. 3 (test run A) and 4 (test run B). The lapping plates were about 41 cm in diameter, about 0.6 mm thick and held four 125 mm wafers. The slurry slots between each wafer (see FIG. 4) were about 140 mm long and extended about equally inside and outside, respectively, the inner and outer tangential circumferences to the wafer holes. The slots had a circumferential width of about 10 mm. About 25 micrometers of material was removed from each side of the semiconductor wafers.

Test run A shows the results typically obtained with the prior art process and lapping plate illustrated in FIG. 3 and Test run B shows the results obtained with the invented process and lapping plate illustrated in FIG. 4, with the slots as described above. Except for changing the lapping plates, the other conditions of the tests (slurry composition, lap speed, lap pressure, etc.) were held constant. The time needed remove the same thickness of material (RUN TIME) and the edge-to-edge taper on the finished wafers (FINAL TAPER) was measured for each test run. The results are shown in TABLE 1 below. The differences arise from providing the additional slurry holes in the lapping plate. It will be seen that the lapping process of the present invention gives significantly reduced lap times for removing the same amount of material, i.e., faster lapping, and gives significantly less taper, i.e., flatter wafers. This is of great practical significance.

TABLE I

TEST LAPPING RESULTS FOR SILICON WAFERS

| TEST # | RUN TIME (min.) | FINAL TAPER (Micrometers) |
|---|---|---|
| A | 8.0 | 12.5 |
| B | 4.5 | 7.6 |

Having thus described the invention, it will be apparent to those of skill in the art that the present invention provides an improved means and method for lapping or polishing thin wafers, especially semiconductor wafers, and further provides an improved means and method for distributing slurry to the faces of the wafers being lapped or polished, and still further provides an improved means and method wherein the distribution of slurry may be controlled for the purpose of correcting pre-existing wafer non-uniformities.

While the present invention has been illustrated primarily in terms of lapping or polishing semiconductor wafers and of use of lapping plates of particular configuration, those of skill in the art will understand that the improved means and method applies to other materials and to lapping plates of other configuration as well. Accordingly, it is intended to included all such variations as will occur to those of skill in the art based on the description herein in the claims that follow.

I claim:

1. A process for treating major faces of thin wafers, comprising:

providing a lapping plate of a pre-determined thickness and having multiple wafer holes extending therethrough adapted to receive the thin wafers with their major faces approximately parallel to major faces of the lapping plate, and having multiple slurry holes extending therethrough, wherein the slurry holes are located between the wafer holes and spaced apart therefrom;

placing the lapping plate between platens of a polishing apparatus and wafers in the wafer holes; and rotating the lapping plate while feeding a slurry thereto so that the slurry penetrates the slurry holes to come into contact with lower faces of the wafers.

2. The method of claim 1 wherein the providing step comprises providing a circular lapping plate with circular wafer holes whose centers are located on a common circumference.

3. The method of claim 2 wherein the providing step comprises providing slurry holes having long dimensions arranged on radii of the circular lapping plate between the wafer holes.

4. The method of claim 3 wherein the providing step comprises providing a lapping plate with slurry holes having inner ends and outer ends at predetermined radii of the lapping plate which are substantially equal, respectively, to radii of inner and outer circumferences tangential to the wafer holes.

5. The method of claim 3 wherein the providing step comprises providing slurry holes of a substantially uniform circumferential width.

6. A process for treating major faces of thin wafers, comprising:

providing a circular lapping plate having N evenly spaced circular wafer holes of substantially equal diameter tangential to spaced-apart first and second circumferences, and N slurry holes located between the N wafer holes and at least partly between the first and second circumferences;

placing the lapping plate between platens of a polishing apparatus and wafers in the wafer holes; and rotating the lapping plates while feeding a treating slurry thereto so that slurry penetrates the slurry holes and contacts lower faces of the wafers.

7. The process of claim 6 wherein the providing step comprises providing slurry holes of a substantially uniform circumferential width.

8. The process of claim 6 wherein the providing step comprises providing radially oriented slurry holes of a substantially uniform length.

9. The process of claim 6 wherein the providing step comprises providing slurry holes of a non-uniform circumferential width.

10. An apparatus for lapping or polishing major faces of thin wafers, comprising a lapping plate of a pre-determined thickness and having multiple wafer holes extending therethrough adapted to receive the thin wafers with their major faces approximately parallel to major faces of the lapping plate, and having multiple slurry holes ahead of the wafer holes in the direction of rotation of the lapping plate and spaced apart from the wafer holes.

11. The apparatus claim 10 wherein the lapping plate is circular with circular wafer holes whose centers are located on a common circumference.

12. The apparatus of claim 11 wherein the slurry holes have long dimensions arranged on radii of the circular lapping plate between the wafer holes.

13. The apparatus of claim 12 wherein the slurry holes have inner and outer ends at predetermined radii of the lapping plate which are, respectively, substantially equal to radii of inner and outer circumferences tangential to the wafer holes.

14. The apparatus of claim 13 wherein the slurry holes have a substantially uniform circumferential width.

15. The apparatus of claim 10 wherein the lapping plate is circular and has N evenly spaced circular wafer holes of equal diameter tangential to spaced-apart first and second circumferences, and N slurry holes located between the N wafer holes and at least partly between the first and second circumferences.

16. In an apparatus for treating major faces of thin wafers, the improvement comprising, a circular lapping plate having N evenly spaced circular wafer holes of substantially equal diameter tangential to spaced-apart first and second circumferences, and N slurry holes located between the N wafer holes and at least partly between the first and second circumferences.

17. The apparatus of claim 16 wherein the slurry holes are of a substantially uniform circumferential width.

18. The apparatus of claim 16 wherein the slurry holes have a substantially uniform radially oriented length.

19. The apparatus of claim 16 wherein the slurry holes have a non-uniform circumferential width.

20. The apparatus of claim 16 wherein the slurry holes extend radially substantially between the first and second circumferences.

* * * * *